US010576750B2

(12) United States Patent
Neeb et al.

(10) Patent No.: US 10,576,750 B2
(45) Date of Patent: Mar. 3, 2020

(54) METHOD FOR COMPENSATING FOR DISRUPTION TORQUES IN THE DRIVING OF A JETTING CYLINDER

(71) Applicant: HEIDELBERGER DRUCKMASCHINEN AG, Heidelberg (DE)

(72) Inventors: Steffen Neeb, Bensheim (DE); Nicklas Raymond Norrick, Heddesheim (DE); Alexander Sendobry, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/271,937

(22) Filed: Feb. 11, 2019

(65) Prior Publication Data

US 2019/0291458 A1 Sep. 26, 2019

(30) Foreign Application Priority Data

Mar. 22, 2018 (DE) ..... 10 2018 204 379

(51) Int. Cl.
*B41J 2/21* (2006.01)
*B41J 29/393* (2006.01)
*B41J 2/01* (2006.01)

(52) U.S. Cl.
CPC ..... *B41J 2/2103* (2013.01); *B41J 2/01* (2013.01)

(58) Field of Classification Search
CPC ..... B41J 2/2103; B41J 29/393; B41J 2/01; B41L 3/02; B41F 5/02; B41F 19/00; B41F 23/08; B41F 13/24
See application file for complete search history.

(56) References Cited

U.S. PATENT DOCUMENTS 6,095,043 A * 8/2000 Hartmann ..... B41F 13/0045 101/177
8,376,640 B2 2/2013 Ogawa
(Continued)

FOREIGN PATENT DOCUMENTS

DE 102005039689 A1 3/2006
DE 102014225256 A1 6/2016
EP 3089352 A1 11/2016

*Primary Examiner* — Thinh H Nguyen
(74) *Attorney, Agent, or Firm* — Laurence A. Greenberg; Werner H. Stemer; Ralph E. Locher

(57) ABSTRACT

A method for compensating for disruption torques in driving a jetting cylinder in an inkjet printing machine includes recording print image products for at least one color and at least one complete rotation of the jetting cylinder by using an image sensor and using a computer for a time parallel measurement of a driving torque of the jetting cylinder, generating an average gray value profile above a circumferential coordinate based on the recorded image data by using the computer, transforming the average gray value profile and the measured profile of the driving torque into a frequency range by using a computer-assisted Fourier transform and extracting order components from the frequency range. A periodic compensation torque is calculated based on the extracted order components, and the calculated periodic compensation torque is factored-in when actuating the jetting cylinder of the inkjet printing machine in the course of a printing operation.

8 Claims, 4 Drawing Sheets

(56) References Cited

U.S. PATENT DOCUMENTS

| | | | | |
|---|---|---|---|---|
| 8,850,983 | B2 * | 10/2014 | Leib | B41F 19/00<br>101/216 |
| 9,878,533 | B2 | 1/2018 | Sonnauer | |
| 2009/0046325 | A1 | 2/2009 | Paul et al. | |
| 2017/0087910 | A1 | 3/2017 | Nagashima | |

* cited by examiner

METHOD FOR COMPENSATING FOR DISRUPTION TORQUES IN THE DRIVING OF A JETTING CYLINDER

CROSS-REFERENCE TO RELATED APPLICATION

This application claims the priority, under 35 U.S.C. § 119, of German Patent Application DE 10 2018 204 379.5, filed Mar. 22, 2018; the prior application is herewith incorporated by reference in its entirety.

BACKGROUND OF THE INVENTION

Field of the Invention

The present invention relates to a method for compensating for disruptions in the drive of an inkjet printing machine.

The technical field of the invention is the field of digital printing.

In inkjet printing machines, a printing substrate is conveyed through the machine by cylinders disposed in line. In that context, ink density fluctuation occurs in the circumferential direction of the cylinders. Those ink density fluctuation may have various causes, among them an uneven movement of the paper caused by geometric deficiencies of the printing substrate guiding system, for instance due to diameter fluctuation in a cylinder or torque fluctuation within the machine in turn caused by imbalances and gripper curves and periodic errors in the image data path.

Inkjet printing machines have a rotary encoder, for instance for driving the jetting cylinder. The rotary encoder provides the current circumferential position in accordance with the future image resolution to the control unit of the inkjet system. When such an initial signal is emitted by the rotary encoder, a corresponding ink drop will not hit the substrate until after a certain amount of time has passed because of the required signal emitting time and the time the drop needs to travel. Successive ink drops will only be disposed on the printing substrate at the desired distance in accordance with the image resolution if the paper surface moves evenly at a constant speed.

Surface speed changes will inevitably lead to modulation in accordance with the speed changes among the ink drops that hit the printing substrate. If the speed changes follow a specific machine rule, that modulation may be sufficiently conspicuous to become visible in the density profile of the printing substrate.

That becomes a problem especially when multiple colors are printed on top of one another to create mixed colors. Every single color separation exhibits the density disruption on the printing substrate as a result of the uneven rotation and the color separations differ in terms of their phase positions. Since the individual colors are disposed downstream of one another in the circumferential direction and are thus printed with an offset in time, a defect resulting from an uneven rotation of the cylinder will develop on different locations on the printing substrate for every color. As a result, some locations may be off color in terms of the color space and may exhibit transverse stripes in the print.

In an inkjet printing machine, all cylinders are double-size except for the jetting cylinder. The jetting cylinder is a quadruple-size cylinder. All cylinders have manufacturing-related imbalances, i.e. the center of mass of the cylinder is not located within its axis of rotation. When an unbalanced cylinder rotates in the gravitation field, there is an alternating torque of the cylinder order, e.g. of the $0.25^{th}$ order for the jetting cylinder and of the $0.5^{th}$ order for the guide and varnishing cylinders, in the form of additive disruption torques. An actuation of the grippers also affects the torque balance of the cylinders and results in rotary imbalances of integer orders in the inkjet printing machine.

At the current printing speed of inkjet printing machines and probably also at the printing speeds the future aspires to, those disrupting torques have a comparatively great influence on the smoothness of the rotary movement of the machine. At 2,500 rotations per hour, any given torque causes a relative offset on the circumference that is 50 times greater than at a speed of 18,000 rotations per hour. Due to manufacturing tolerances, the surface of the jetting cylinder has periodic waves that include the $0.25^{th}$ order, the $0.5^{th}$ order, and all integer orders. In addition, the rotary encoder may cause periodic defects due to internal and external defects such as assembly defects. Those periodic defects affect the evenness of the cylinder rotation and the timing of the image data path, which potentially also has inherent periodic defects. The surface speed fluctuation is a combination of all of those defects.

German Patent Application DE 10 2014 225 256 A1, corresponding to U.S. Pat. No. 9,878,533, discloses a method for ink-jet printing onto containers, wherein at least one container is rotated and/or transported along at least one curved trajectory and associated surface velocities of lateral circumferential portions of a lateral container surface are measured, wherein printing times assigned to the circumferential portions and/or intermediate portions and/or an angular velocity of the containers are adapted to the surface velocities. A compensation of print advance fluctuation caused by varying surface velocities upstream of print heads results in a uniform print resolution and a seamless transition between print elements. However, no determination of the additive disruption torque is disclosed. The only aspect known about the calculation of the compensation torque is that the rotary speed of the containers is to be adapted to the surface velocities. An accurate calculation of the compensation torque adapted to the problem of ink density fluctuation as described above is thus impossible.

SUMMARY OF THE INVENTION

It is accordingly an object of the invention to provide a method for compensating for disruption torques in the driving of a jetting cylinder, which overcomes the hereinafore-mentioned disadvantages of the heretofore-known methods of this general type and which provides for actuating the jetting cylinder in an inkjet printing machine that allows disruption torques that occur when the machine is driven to be compensated for in an efficient way.

With the foregoing and other objects in view there is provided, in accordance with the invention, a method for compensating for disruption torques in the driving of a jetting cylinder in an inkjet printing machine by using a computer. The method comprises the steps of recording print image products for at least one color and at least one complete rotation of the jetting cylinder by using an image sensor and, in a way parallel in time, measuring the driving torque of the jetting cylinder by using the computer, generating an average gray value profile above the circumferential coordinate based on the recorded image data by using the computer, transforming the average gray value profile and the measured profile of the driving torque into the frequency range by using a computer-assisted Fourier transform and extracting order components from the frequency range, calculating a periodic compensation torque based on the extracted order components, and factoring-in the calculated periodic compensation torque when actuating the jetting cylinder of the inkjet printing machine in the course of a printing operation.

The core aspect of the method is to determine disturbing factors that influence the toque of the driven jetting cylinder as accurately as possible. These disturbing factors have various causes, all of which affect the driving of the jetting cylinder and may be represented in the form of an additive disruption torque. This additive disruption torque needs to be accurately determined to be able to calculate a corresponding compensation torque that counterbalances the additive disruption torque. The additive disruption torque is caused by geometric defects in the sheet-guiding system, fluctuation in the torque balance of the printing machine caused by imbalances or gripper curves and periodic errors in the image data path. An important aspect in determining the exact disruption torque is a simultaneous recording of image data of printed print image products over a complete rotation of the jetting cylinder and, parallel in time, a measurement of the driving torque for driving the jetting cylinder during the recording of the print image. The gray value profile obtained from the image data that have been recorded in this way may be converted into the frequency range by using a Fourier transform. The profile of the measured driving torque of the jetting cylinder is likewise transformed. Now order components may be extracted from the spectrum in the frequency range that has been obtained in this way. These order components may then be used to calculate the periodic compensation torque that may be applied to actuate the jetting cylinder in order to compensate for the additive disruption torque that has occurred.

Advantageous and thus preferred further developments of the method will become apparent from the associated dependent claims and from the description together with the associated drawings.

Another preferred development of the method of the invention in this context is that to record print image products and to measure the driving torque in a way parallel in time, at least two similar identification runs are carried out, with the measured driving torque data only differing in terms of the respective additive periodic disruption torque in the drive. In order to make sure that sufficient data are available for the method of the invention and that no measurement errors have occurred that would irreversibly falsify the result, at least two so-called identification runs are required such as recording the print image products and measuring the driving torque. This should allow the compensation torque to be calculated with sufficient accuracy.

A further preferred development of the method of the invention in this context is that to increase error tolerance, at least 20 similar identification runs are carried out, one third of which is used to calculate the periodic compensation torque by using the computer and the other two thirds of which are used to validate the data set by using the computer. In order to provide a determination of the average gray value profile and the torque profile that is as accurate as possible, the number of identification runs to be carried out should be sufficient to allow part of them to be used for validating the determined set of data. One third of the calculated data is then used to calculate the periodic compensation torque whereas two thirds are used to validate the determined set of data in a corresponding way. This provides sufficient robustness and error tolerance when the data of the gray value profile and the torque profile are established.

An added preferred development of the method of the invention in this context is that the at least 20 similar identification runs are influenced by selecting the amplitude and phase positions of the disruption torques relative to one another by the computer in such a way that the conditioning of the resultant equation system of the respective additive periodic disruption torque in the drive is as easy to calculate for the computer as possible, wherein those at least two additive periodic disruption torques in the drive are selected for which the conditioning of the resultant equation system is most favorable. In the course of the calculation of the periodic compensation torque, a set of equations is created that needs to be solved in a corresponding way for the calculation. The complexity of this system of equations depends on the amplitude and phase positions of the additive disruption torques relative to one another. By choosing those among the at least twenty similar identification runs that have favorable amplitude and phase positions relative to one another and using them to calculate the compensation torque, one obtains a system of equations that is accordingly less difficult to solve for the calculation of the periodic compensation torque. The identification rotations that have unfavorable amplitude and phase positions may then be used in accordance with the invention to validate the set of data.

An additional preferred development of the method of the invention in this context is that the calculation of the periodic compensation torque by the computer is carried out by using a machine learning approach by a repeated application of training data sets. It is expedient to use a machine learning approach comparable to the application of a neural network to calculate the periodic compensation torque by solving the set of equations. In this process, a repeated application of training data sets enables a self-learning algorithm running on the computer to calculate the periodic compensation torque in an efficient way. The more training data sets are provided to the self-learning algorithm, the more efficiently it will calculate the periodic compensation torque in a real application with genuine data.

Another preferred development in this context is that the average gray value profile in the frequency range is separately processed mathematically by the computer, with orders below one treated differently from orders greater than or equal to one. Since like most printing cylinders, the jetting cylinder has a gap, for instance for positioning the grippers, where no printing can take place, the rotary image recording process does not provide any image data for the regions of this gap. The recorded gray value profile thus has a gap that will persist even in the Fourier transform into the frequency range. Therefore the data on the transformed gray value profile require separate mathematical processing, wherein the resultant orders below 1 in the frequency range are treated differently than orders greater than or equal to 1.

An added preferred development of the method of the invention in this context is that to record the print image products, an inline camera of the image recording system of the inkjet printing machine is used as the image sensor. An image sensor needs to be used to record the gray value profile. It is expedient to use the inline camera of the image recording system in the printing machine if the printing machine has such an image recording system for quality control purposes. An advantage of using the inline camera of the image recording system is that no additional image sensor needs to be installed in the inkjet printing machine and no structural changes need to be made. An advantage of this approach over an external solution is that the printed sheet does not have to be separately analyzed and handled at a later point.

A concomitant further development of the method of the invention in this context is that precisely two identification runs are carried out to record print image products and to measure the driving torque in a way parallel in time, in which one disruption torque is exclusively formed of pure sine terms and the other disruption torque is formed of cosine terms of the same amplitude per frequency node. As an alternative to carrying out more than two identification runs or even more than twenty, there is the option of carrying out only two identification runs, one identification run with a disruption torque exclusively of sine terms and the second identification run with a disruption torque exclusively of cosine terms of identical amplitude per frequency node. This method is faster than carrying out significantly more identification runs and it creates correspondingly less waste. A disadvantage is a greater sensitivity to external disruptions such as measurement noise, etc.

Other features which are considered as characteristic for the invention are set forth in the appended claims.

Although the invention is illustrated and described herein as embodied in a method for compensating for disruption torques in the driving of a jetting cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The invention as such as well as further developments of the invention that are advantageous in structural and/or functional terms will be described in more detail below with reference to the associated drawings and based on at least one preferred exemplary embodiment.

DETAILED DESCRIPTION OF THE INVENTION

Figure 1:
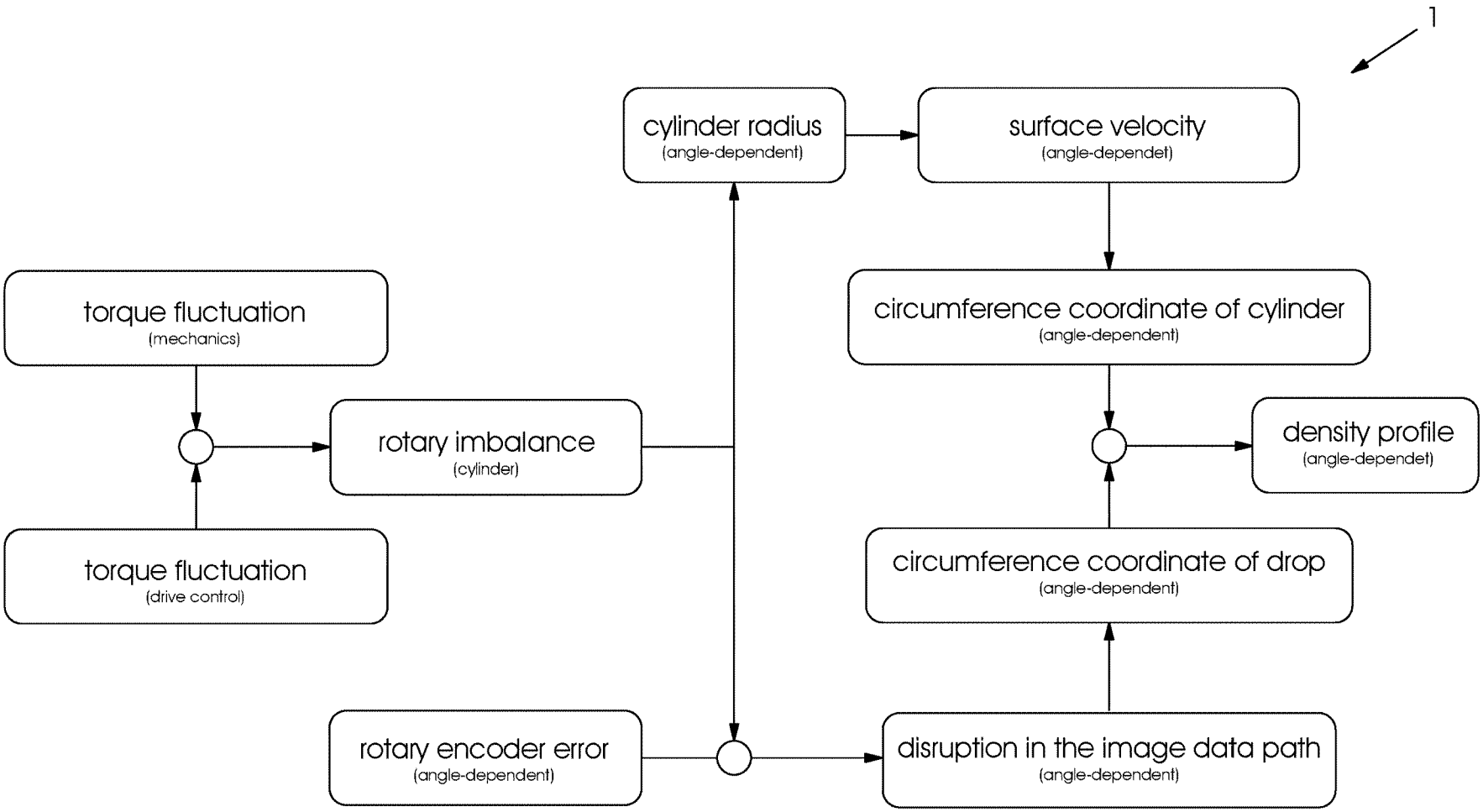
FIG. 1 is a diagram indicating potential causes of additive disruption torques.
Figure 4:
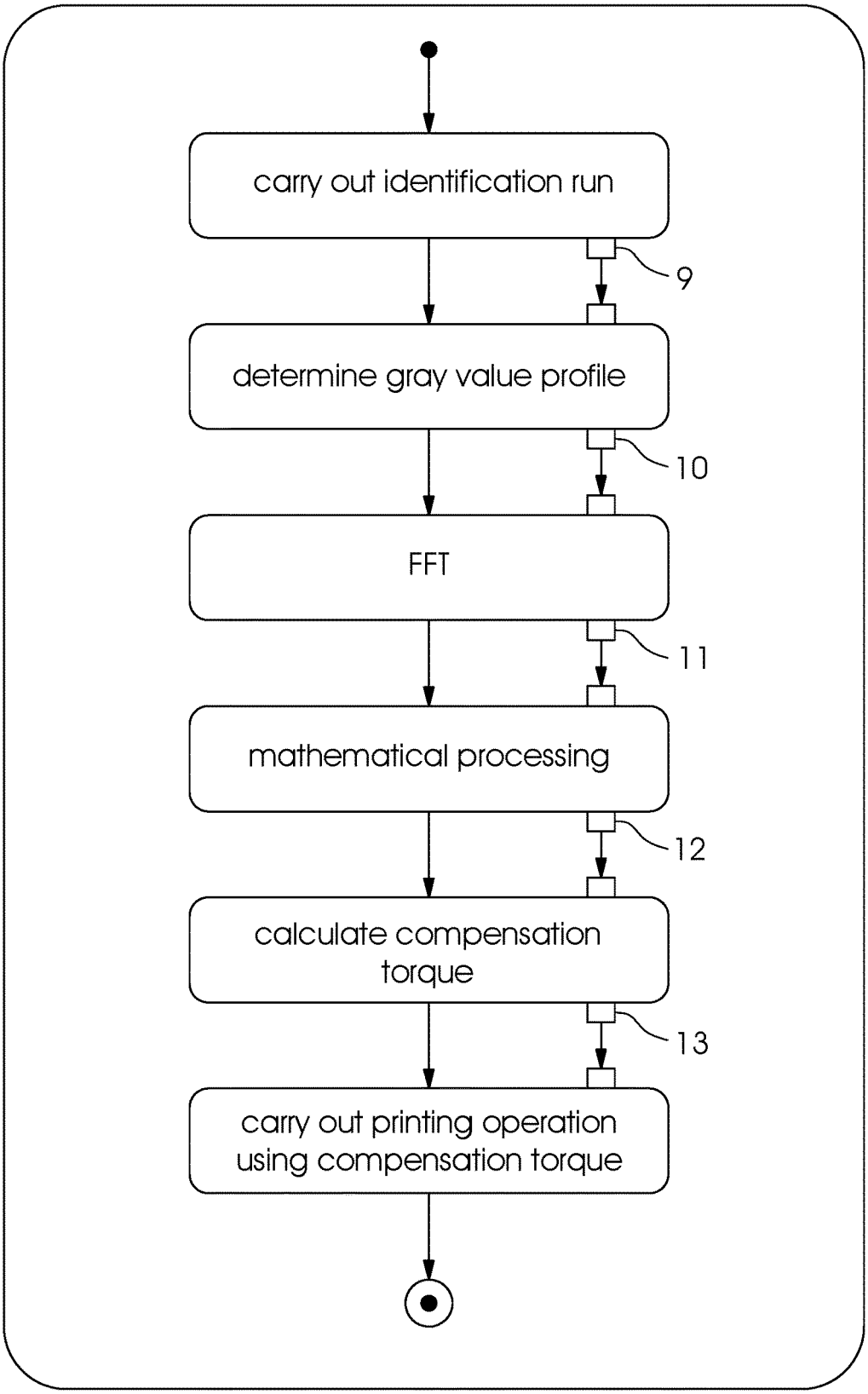
FIG. 4 is a flow chart of the method of the invention.

Referring now in detail to the figures of the drawings, in which mutually corresponding elements have the same reference symbols, and first, particularly, to FIG. 4 thereof, there is seen a preferred exemplary embodiment of the method of the invention illustrated in the form of a flow chart. FIG. 4 shows that upon an initial start-up of the printing machine, at least two identification runs need to be carried out in a similar way. In this process, an inline camera records images of print results 9 for at least one color and at least one complete rotation of a jetting cylinder and, in synchronism with the recordings, the driving torque of the machine is measured. The measurements only differ in terms of an additive periodic disruption torque in the drive, which includes all of the relevant order components. Potential causes 1 of this additive periodic disruption torque are shown in FIG. 1. The figure clearly shows a chain of effects from the disruption and the respective individual causes thereof to a resultant density profile.

Figure 2:
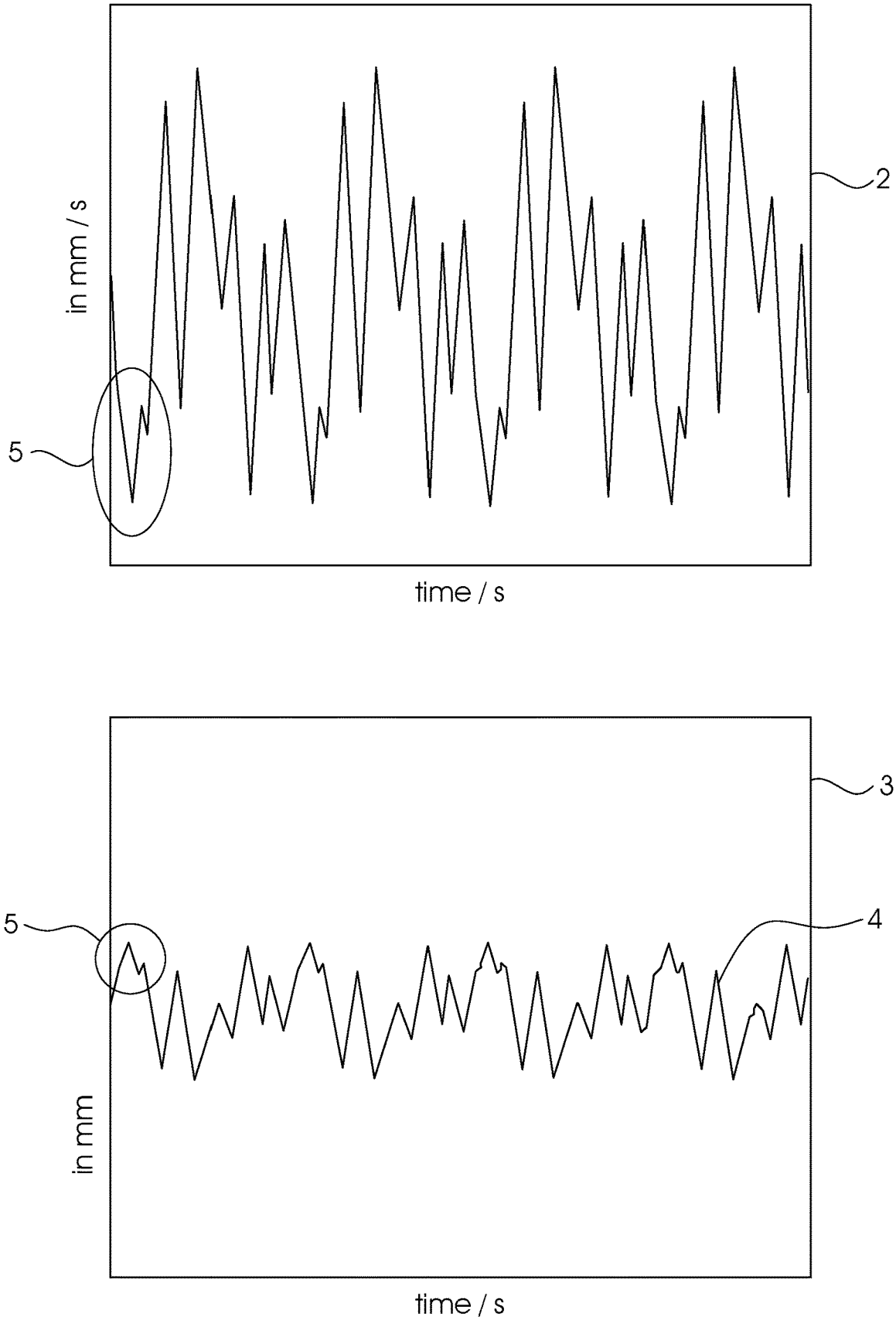
FIG. 2 includes two diagrams illustrating the fundamental relationship between velocity changes on the jetting cylinder and resultant ink density fluctuations.
Figure 3:
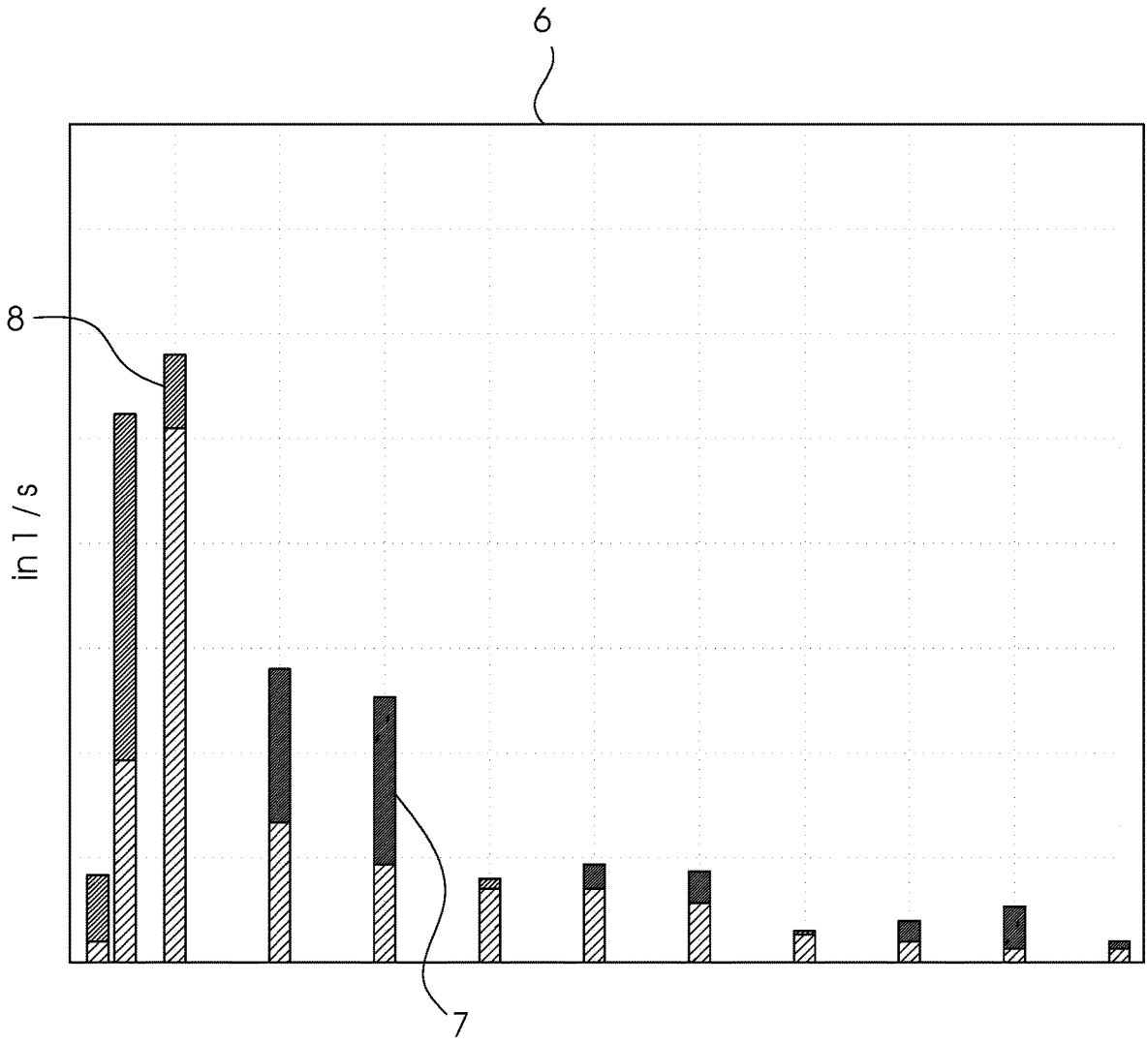
FIG. 3 is a diagram illustrating different ink density fluctuations of specific orders in the frequency range.

Based on the images of the print results, an average gray value profile 10 is then generated above the circumference coordinate in an image processing step. By using a Fourier transform, this profile 10 and the torque profile are converted to the frequency range where the order components indicated above are extracted from the gray value profile in a frequency range 11. FIG. 2 illustrates the correlation between jetting cylinder velocity changes and the resultant color density profile fluctuations. The first image of FIG. 2 represents the measured circumferential speed of the jetting cylinder 2. The second image illustrates established position errors 3 of ink drops that have hit the printing substrate. These errors cause the aforementioned color density fluctuation. The representation is in the time range and the illustrated signal corresponds to a signal 4 of the encoder on a jetting cylinder. Changes in surface velocity 8 cause defects in the drop positions and thus in a color density profile 7. The figure clearly illustrates a reverse correlation 5 between the two measurement curves. Conversely, FIG. 3 illustrates a frequency range 6 with the orders in question, indicating different order components such as color density 7 or surface velocity 8 for different order components.

Due to the gap in the jetting cylinder in which no image information is generated, the gray value profile needs to be separately mathematically processed, resulting in a gray value profile with reduced orders 12. In this context, orders below one and orders greater than or equal to one are treated differently.

These data and the knowledge about the additive periodic disruption torque are used to calculate a periodic compensation torque 13 that provides a fluctuation-free, i.e. constant color density profile in the circumferential direction.

An aspect to be considered when the at least two additive periodic disruption torques are selected is that the conditioning of the resultant system of equations is as favorable as possible. This conditioning may be influenced by the amplitude and phase positions of the disruption torques relative to one another.

Ideally, about 20 measurements with different disruption torques are recorded. One third of these measurements is used to calculate the periodic compensation torque 13, for instance in the form of a set of training data as in the machine learning approach, whereas the other two thirds are used to validate the data set. This causes the process to be sufficiently robust in the case of disturbances.

If the periodic compensation torque 13 that has been calculated in this way is not valid for all modes of operation of the machine such as format adjustment, varnish on/off, precoat on/off, etc, the process needs to be repeated for every configuration that is of interest. The respective additive disruption torque would then be applied in accordance with the mode of operation.

The error found in the surface velocity 8 and the image data path as described above are thus reduced and, in a best-case scenario, completely eliminated.

Since most inkjet printing machines that are currently in use have all the required components and sensors, no additional hardware costs are incurred.

Moreover, there is an alternative embodiment, which involves only two identification runs. In this context, the disruption torque of the first identification run is exclusively formed of pure sine terms of identical amplitude per frequency node, whereas the disruption torque of the second identification run is exclusively formed of pure cosine terms.

An advantage of this approach is that it is faster and consumes less paper.

The following is a summary list of reference numerals and the corresponding structure used in the above description of the invention:

1 causes of additive disruption torques
2 circumferential jetting cylinder speed
3 position error of an ink drop
4 encoder on the jetting cylinder
5 reverse correlation
6 frequency range with different orders
7 color density
8 surface velocity
9 recorded prints
10 determined gray value profile above circumference coordinate
11 Fourier-transformed gray value profile in the frequency range
12 gray value profile in the frequency range with reduced orders
13 periodic compensation torque

The invention claimed is:

1. A method for compensating for disruption torques in the drive of a jetting cylinder in an inkjet printing machine, the method comprising the following steps:

using an image sensor to record print image products for at least one color and at least one complete rotation of the jetting cylinder, and using a computer for a time parallel measurement of a driving torque of the jetting cylinder;

using the computer to generate an average gray value profile above a circumferential coordinate based on recorded image data;

using a computer-assisted Fourier transform to transform the average gray value profile and a measured profile of the driving torque into a frequency range, and extracting order components from the frequency range;

calculating a periodic compensation torque based on extracted order components; and factoring-in the calculated periodic compensation torque when actuating the jetting cylinder of the inkjet printing machine in a course of a printing operation.

2. The method according to claim 1, which further comprises carrying out at least two similar identification runs to record print image products and to measure the driving torque parallel in time, with measured driving torque data only differing in terms of a respective additive periodic disruption torque in the drive.

3. The method according to claim 2, which further comprises increasing error tolerance by carrying out at least 20 similar identification runs, using one-third of the identification runs to calculate the periodic compensation torque by using the computer and using two-thirds of the identification runs to validate data set by using the computer.

4. The method according to claim 3, which further comprises using the computer to influence the at least 20 similar identification runs by selecting amplitude and phase positions of the disruption torques relative to one another in such a way that conditioning of a resultant equation system of a respective additive periodic disruption torque in the drive is as easy to calculate for the computer as possible, and selecting at least two additive periodic disruption torques in the drive for which the conditioning of the resultant equation system is most favorable.

5. The method according to claim 1, which further comprises carrying out the calculation of the periodic compensation torque by the computer by using a machine learning approach with a repeated application of training data sets.

6. The method according to claim 1, which further comprises using the computer to separately mathematically process the average gray value profile in the frequency range, with orders below one treated differently from orders greater than or equal to one.

7. The method according to claim 1, which further comprises using an inline camera of an image recording system of the inkjet printing machine as the image sensor to record the print image products.

8. The method according to claim 1, which further comprises carrying out precisely two identification runs to record print image products and to measure the driving torque parallel in time, exclusively forming one disruption torque of pure sine terms and forming the other disruption torque of cosine terms of identical amplitude per frequency node.

* * * * *